US008619068B2

(12) United States Patent
Chiba

(10) Patent No.: US 8,619,068 B2
(45) Date of Patent: Dec. 31, 2013

(54) ELECTRONIC APPARATUS, DISPLAY PANEL CONTROL DEVICE AND DISPLAY PANEL CONTROL METHOD

(75) Inventor: Hiroaki Chiba, Sagamihara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 194 days.

(21) Appl. No.: 13/329,018

(22) Filed: Dec. 16, 2011

(65) Prior Publication Data

US 2012/0320020 A1 Dec. 20, 2012

(30) Foreign Application Priority Data

Jun. 14, 2011 (JP) ..... 2011-132700

(51) Int. Cl.
*G09G 5/00* (2006.01)

(52) U.S. Cl.
USPC ..... 345/211; 345/204

(58) Field of Classification Search
USPC ..... 345/204–213, 690–699
See application file for complete search history.

(56) References Cited

U.S. PATENT DOCUMENTS

2008/0205519 A1* 8/2008 Goodart et al. ..... 375/240.12
2009/0182917 A1* 7/2009 Kim ..... 710/106
2009/0278763 A1* 11/2009 Zeng et al. ..... 345/1.1
2010/0289950 A1* 11/2010 Kobayashi ..... 348/469
2011/0001744 A1* 1/2011 Chen et al. ..... 345/212
2011/0007041 A1* 1/2011 Huang et al. ..... 345/204
2011/0050734 A1* 3/2011 Syed ..... 345/690
2012/0026202 A1* 2/2012 Maciesowicz et al. ..... 345/690

FOREIGN PATENT DOCUMENTS

JP 2007-147901 6/2007
JP 2009-089366 4/2009

* cited by examiner

*Primary Examiner* — Dmitriy Bolotin
(74) *Attorney, Agent, or Firm* — Blakely, Sokoloff, Taylor & Zafman LLP

(57) ABSTRACT

According to one embodiment, a control module executes, after the electronic apparatus is powered on, a process of powering on a display panel, a process of receiving a hot-plug detection signal from the display panel, a link training process, and a process of transmitting a video signal to the display panel in the video signal transmission mode determined by the link training process. The control module stops the transmission of the video signal to the display panel in a state in which the display panel is kept in a power-on state, when a display OFF request event occurs, and transmits the video signal to the display panel in the determined video signal transmission mode, when a display ON request event occurs in a state in which the display panel is in the power-on state and the transmission of the video signal to the display panel is stopped.

8 Claims, 6 Drawing Sheets

ELECTRONIC APPARATUS, DISPLAY PANEL CONTROL DEVICE AND DISPLAY PANEL CONTROL METHOD

CROSS-REFERENCE TO RELATED APPLICATIONS

This application is based upon and claims the benefit of priority from prior Japanese Patent Application No. 2011-132700, filed Jun. 14, 2011, the entire contents of which are incorporated herein by reference.

FIELD

Embodiments described herein relate generally to an electronic apparatus comprising a display panel, a display panel control device for controlling the display panel, and a display panel control method.

BACKGROUND

In recent years, various electronic apparatuses, such as a portable personal computer and a digital TV, have been developed. Most of these electronic apparatuses comprise display panels such as liquid crystal display (LCD) panels.

In the electronic apparatus comprising the display panel, an LVDS I/F (Low voltage difference signal Interface) is used as an internal video interface for controlling the display panel. In the control of the LCD panel with the LVDS I/F, a video signal is sent to the LCD panel after power is supplied to the LCD panel, and thereby an image can be displayed on the LCD panel.

In the meantime, recently, use has begun to be made of an eDP (Embedded Display Port) I/F which is a new internal video interface that takes the place of the LVDS I/F. The eDP (Embedded Display Port) I/F can realize high-speed signal transmission with a less number of signal lines than the number of signal lines of the LVDS I/F. Thus, the eDP may become a dominant signal transmission method for display panels in the future.

However, since the eDP I/F is a standard based on a DisplayPort I/F which is an external video interface, it is necessary to execute processes, such as a hot-plug signal process and a link training process, during a period between power-on of the LCD panel and the transmission of a video signal to the LCD panel. Consequently, in the electronic apparatus using the eDP I/F, a relatively long time is needed from the power-on of the LCD panel until the actual display of the image on the LCD panel. This is a factor leading to degradation in user operability.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an electronic apparatus comprises a display panel. The electronic apparatus further comprises a power supply control module configured to power on or power off the display panel, and a control module. The control module is configured to execute, after the electronic apparatus is powered on, a process of powering on the display panel by using the power supply control module, a process of receiving a hot-plug detection signal from the display panel, a link training process for determining a video signal transmission mode, and a process of transmitting a video signal to the display panel in the video signal transmission mode determined by the link training process. The control module is configured to stop the transmission of the video signal to the display panel in a state in which the display panel is kept in a power-on state, when a display OFF request event occurs after the transmission of the video signal to the display panel, and to transmit the video signal to the display panel in the determined video signal transmission mode, when a display ON request event occurs in a state in which the display panel is in the power-on state and the transmission of the video signal to the display panel is stopped.

Figure 1:
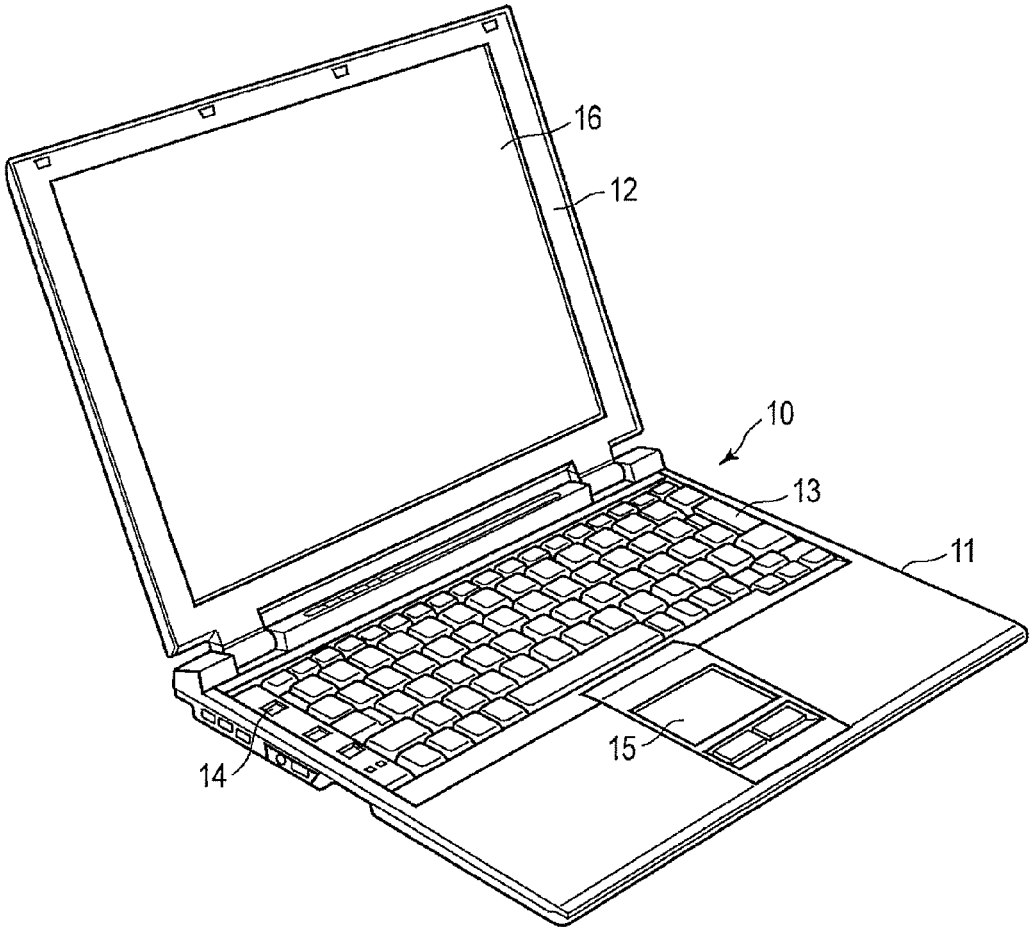
FIG. 1 is an exemplary perspective view illustrating the external appearance of an electronic apparatus according to an embodiment.

FIG. 1 is a perspective view showing the external appearance of an electronic apparatus according to an embodiment. This electronic apparatus may be realized, for example, as a notebook-type personal computer (PC), a tablet PC, a slate PC, a digital TV, etc. In the description below, the case is assumed that the electronic apparatus is realized as a notebook-type personal computer 10.

As shown in FIG. 1, the computer 10 is composed of a computer main body 11 and a display unit 12. A display device, which is composed of an LCD (Liquid crystal Display) 16, is built in the display unit 12. The LCD 16 is a display panel which supports the Embedded Display Port Standard, and includes an eDP (Embedded Display Port) I/F.

The display unit 12 is attached to the computer main body 11 such that the display unit 12 is rotatable between an open position where the top surface of the computer main body 11 is exposed, and a closed position where the top surface of the computer main body 11 is covered. The computer main body 11 has a thin box-shaped housing. A keyboard 13, a power button 14 for powering on/off the computer 10, a pointing device 15, such as a touch pad, are disposed on the top surface of the housing of the computer main body 11. A mouse or a touch panel, for instance, may be used as the pointing device 15.

Figure 2:
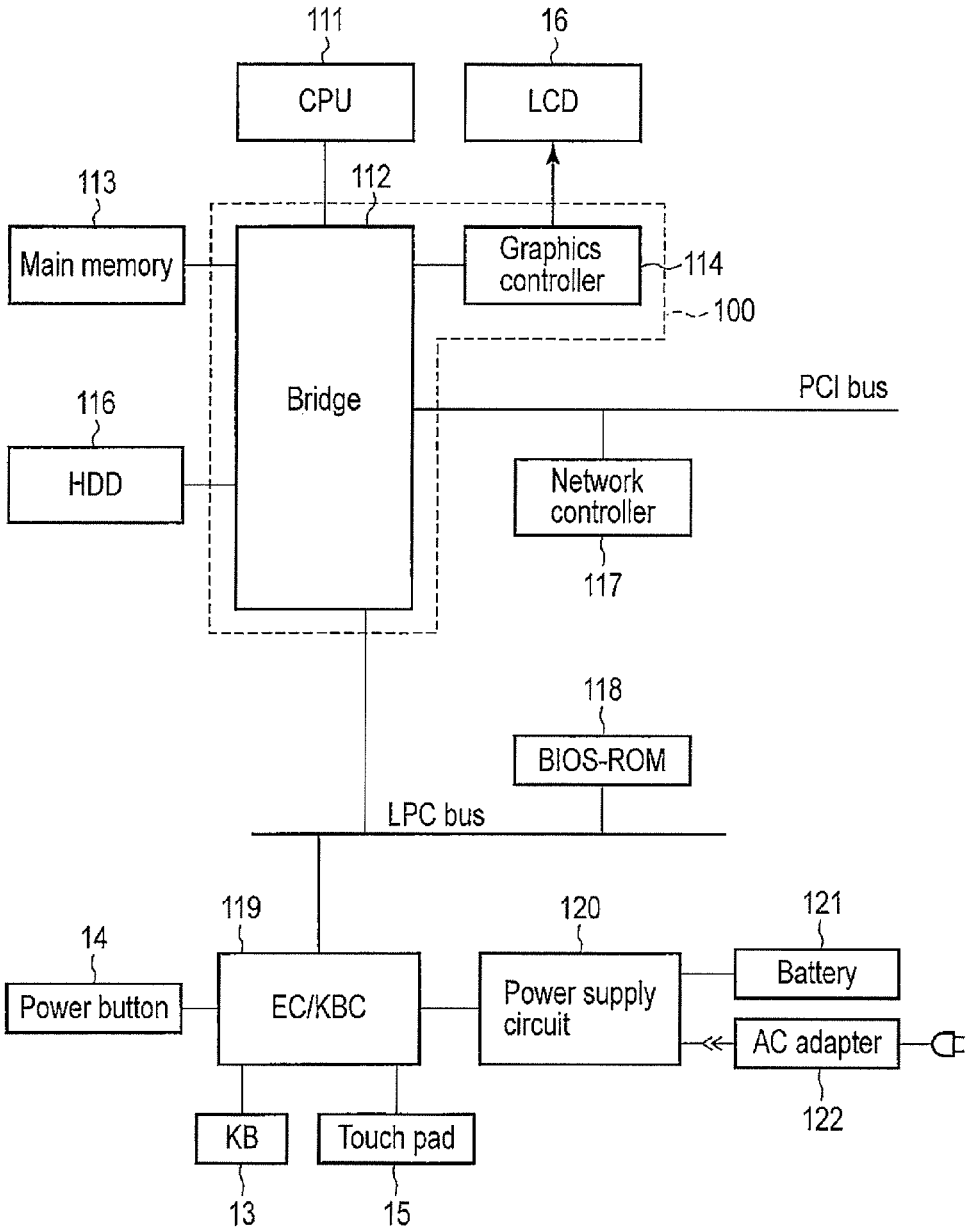
FIG. 2 is an exemplary block diagram illustrating the system configuration of the electronic apparatus according to the embodiment.

FIG. 2 illustrates the system configuration of the computer 10.

The computer 10 comprises a CPU 111, a bridge device 112, a main memory 113, a graphics controller 114, a hard disk drive (HDD) 116, a network controller 117, a BIOS-ROM 118, an embedded controller/keyboard controller (EC/KBC) 119, and a power supply circuit 120.

The CPU 111 is a processor for controlling the operations of the respective components of the computer 10. The CPU 111 executes a BIOS which is stored in the flash BIOS-ROM 118. The BIOS includes an LCD display auto-off function for automatically setting the LCD 16 in a non-display state. For example, when a period, in which an input event, such as a key input or a pointing operation, does not occur, has continued for a threshold time or more, the BIOS sends a display auto-off request (LCD display OFF request), which requests that the LCD 16 be set in the non-display state, to the graphics controller 114. When an input event occurs while the LCD 16 is in the non-display state, the BIOS sends a display ON request (LCD display ON request) to the graphics controller 114, thereby to restore the LCD 16 to the display state.

Furthermore, the BIOS includes a display switching function for switching the display, which displays an image (a screen image), between an internal display (LCD 16) and an external display which is connected to the computer 10. For example, by pressing a predetermined key (hot key) on the keyboard 13, a user can switch the display, which displays the image, between the internal display (LCD 16) and the external display. For example, each time the hot key is pressed, the display that displays the image is switched in an order of, e.g. internal display mode→external display mode→simultaneous display mode→internal display mode'external display mode, . . . ("toggle"). When an event of switching the display which display the image from the internal device to the external device, for example, an event of switching from the internal display mode to the external display mode, or an event of switching from the simultaneous display mode to the external mode, has occurred, the BIOS sends to the graphics controller 114 the above-described display OFF request (LCD display OFF request) which requests that the LCD 16 be set in the non-display state. When an event of switching the display which display the image from the external device to the internal device, for example, an event of switching from the external display mode to the internal display mode, or an event of switching from the simultaneous display mode to the internal mode, has occurred, the BIOS sends the above-described display ON request (LCD display ON request) to the graphics controller 114 in order to restore the LCD 16 to the display state.

In addition, the CPU 111 executes an operating system, various application programs and various utility programs, which are loaded from the HDD 116 into the main memory 113. The above-described LCD display auto-off function may be implemented in the utility programs.

The bridge device 112 includes a function of communicating with the graphics controller 114. In addition, the bridge device 112 includes a memory controller which controls the main memory 113. Besides, the bridge device 112 communicates with devices on a PCI (Peripheral Component Interconnect) bus and devices an LPC (Low PIN Count) bus.

The graphics controller 114 is a display controller which controls the LCD 16 that is used as a display monitor of the computer 10. The above-described eDP (Embedded Display Port) I/F is used as a video signal interface between the graphics controller 114 and the LCD 16. Further, the graphics controller 114 can send a video signal to the above-described external display which is connected to the computer 10.

In the present embodiment, the graphics controller 114 and bridge device 112 function as a display panel controller 100 for controlling the LCD 16.

In order to decrease a time needed for a transition from a non-display state in which no image is displayed on the LCD 16 to a display state in which an image is displayed on the LCD 16, the display panel controller 100 executes, after system boot-up, a hot-plug signal process and a link training process only in a first power-supply sequence (display ON sequence) for the LCD 16 (eDP I/F LCD panel), and skips the execution of the hot-plug signal process and link training process in second and subsequent power-supply sequences (display ON sequence). In other words, after the first power-supply sequence (display ON sequence), the display panel controller 100 keeps the LCD 16 in the power-on state even if an event of a power-off request (LCD display OFF request) occurs. Specifically, when the display OFF request (LCD display OFF request) has occurred, the display panel controller 100 stops transmission of a video signal to the LCD 16 in the state in which the LCD 16 is kept in the power-on state.

To be more specific, the procedure of the LCD (16) control sequence which is executed by the display panel controller 100 is as follows.

(1) In a first power-supply sequence (display ON sequence) after power-on of the computer 10, the display panel controller 100 executes a process of powering on the LCD 16, a process (hot-plug signal process) of receiving a hot-plug detection signal from the LCD 16, a link training process for determining a video signal transmission mode, and a process of transmitting a video signal to the LCD 16 in the video signal transmission mode which is determined by the link training process.

(2) If a display OFF request event has occurred after the transmission of the video signal to the LCD 16, the display panel controller 100 stops the transmission of the video signal to the LCD 16 in the state in which the LCD 16 is kept in the power-on state.

(3) In second and subsequent power-supply sequences (second and subsequent display ON sequences) after the power-on of the computer 10, the display panel controller 100 transmits the video signal to the LCD 16 in the video signal transmission mode which has already been determined in the first power-supply sequence (display ON sequence). Each of the second and subsequent power-supply sequences (each of the second and subsequent display ON sequences) is executed when the display ON request event has occurred in the state in which the transmission of the video signal to the LCD 16 is stopped. Specifically, when the display ON request event has occurred in the state in which the LCD 16 is in the power-on state and the transmission of the video signal to the LCD 16 is stopped, the display panel controller 100 skips the execution of the process of powering on the LCD 16, the hot-plug signal process and the link training process, and transmits the video signal to the LCD 16 in the already determined video signal transmission mode.

(4) When a system power-off request event, which requests power-off of the computer 10, has occurred in the state in which the video signal is being transmitted to the LCD 16, or when the system power-off request event has occurred in the state in which the LCD 16 is in the power-on state and the transmission of the video signal to the LCD 16 is stopped, the display panel controller 100 powers off the LCD 16. If the state at this time is the state in which the video signal is being transmitted to the LCD 16, the display panel controller 100 also stops the transmission of the video signal to the LCD 16.

By the above-described process, the hot-plug signal process and link training process are skipped in the second and subsequent power-supply sequences (display ON sequences). Accordingly, in the second and subsequent power-supply sequences, the time needed for the transition from the state in which no image is displayed on the LCD 16 to the state in which the image is displayed on the LCD 16 can be decreased.

The embedded controller/keyboard controller IC (EC/KBC) 119 is a one-chip microcomputer in which an embedded controller for power management and a keyboard controller for controlling the keyboard (KB) 13 and pointing device 15 are integrated. The EC/KBC 119 cooperates with the power supply circuit 120 to power on/off the computer 10 in accordance with an operation of the power button switch 14 by the user. The power supply circuit 120 generates system power, which is to be supplied to the respective components of the computer 10, by using power from a battery 121 that is incorporated in the computer main body 11, or external power which is supplied via an AC adapter 122.

Figure 3:
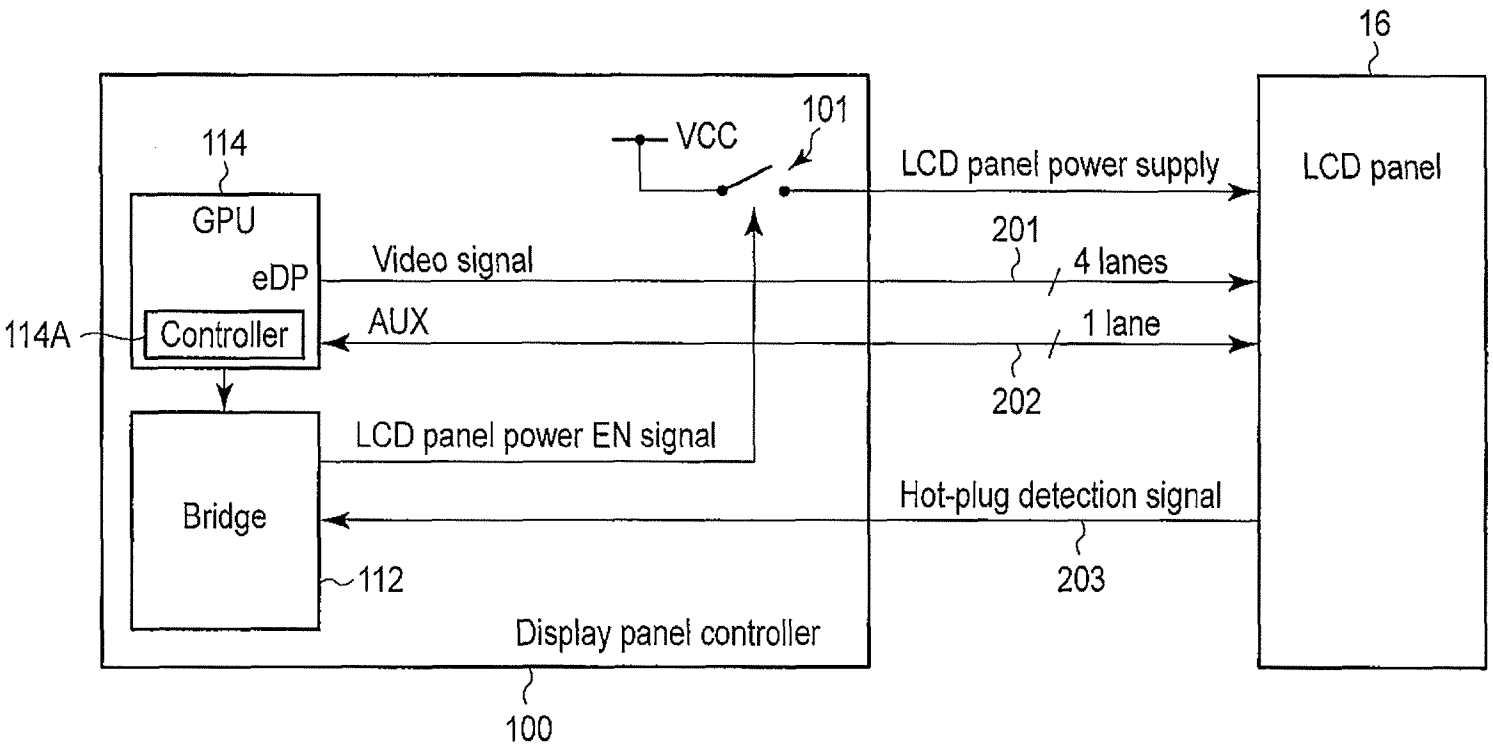
FIG. 3 is a block diagram illustrating a configuration example of a display panel controller provided in the electronic apparatus of the embodiment.

Next, referring to FIG. 3, a configuration example of the display panel controller 100 is described.

As shown in FIG. 3, the display panel controller 100 comprises a power supply switch circuit 101, bridge device 112 and graphics controller (GPU) 114. The power switch circuit 101 is composed of a switch (e.g. FET) which is connected between a power supply terminal VCC and the LCD 16.

The bridge device 112 functions as a power supply controller which powers on or powers off the LCD 16 by turning on or off the power supply switch circuit 101. When the bridge device 112 has received an LCD panel power-on request from the graphics controller (GPU) 114, the bridge device 112 sets an LCD panel power enable (EN) signal in an active state, thereby powering on the LCD 16, that is, supplying LCD panel power to the LCD 16. In addition, when the bridge device 112 has received an LCD panel power-off request from the graphics controller (GPU) 114, the bridge device 112 sets the LCD panel power enable (EN) signal in an inactive state, thereby powering off the LCD 16.

The graphics controller (GPU) 114 controls the LCD 16 via the eDP (Embedded Display Port) I/F. In the eDP I/F, a main data channel 201 (four lanes), a side channel 202 (one lane) which is called "auxiliary (AUX) channel", and a hot-plug detection signal line 203 are defined. The main data channel 201 is used for transmission of a video signal from the graphics controller (GPU) 114 to the LCD 16. The data transfer rate of the main data channel 201 per lane can be variably set. The side channel 202 is a channel which is used, for example, in the link training process for determining the video signal transmission mode. The graphics controller (GPU) 114 communicates with the LCD 16 via the side channel 202, thereby determining the video signal transmission mode (e.g. the number of lanes of a main data channel to be used, the data transfer rate per lane, and the amplitude of the video signal) (link training process).

The hot-plug detection signal line 203 is used for transmitting a hot-plug detection signal from the LCD 16 to the graphics controller (GPU) 114. The hot-plug detection signal is a signal for notifying the graphics controller (GPU) 114 from the LCD 16 that the LCD 16 has been set in an operable state. The graphics controller (GPU) 114 executes the above-described link training process after executing a process (hot-plug signal process) of receiving an active-state hot-plug detection signal from the LCD 16.

The graphics controller (GPU) 114 includes a controller 114A in addition to a graphics processing module which generates a video signal. The controller 114A cooperates with the bridge device 112 to control the above-described power-supply sequence (display ON sequence).

Figure 4:
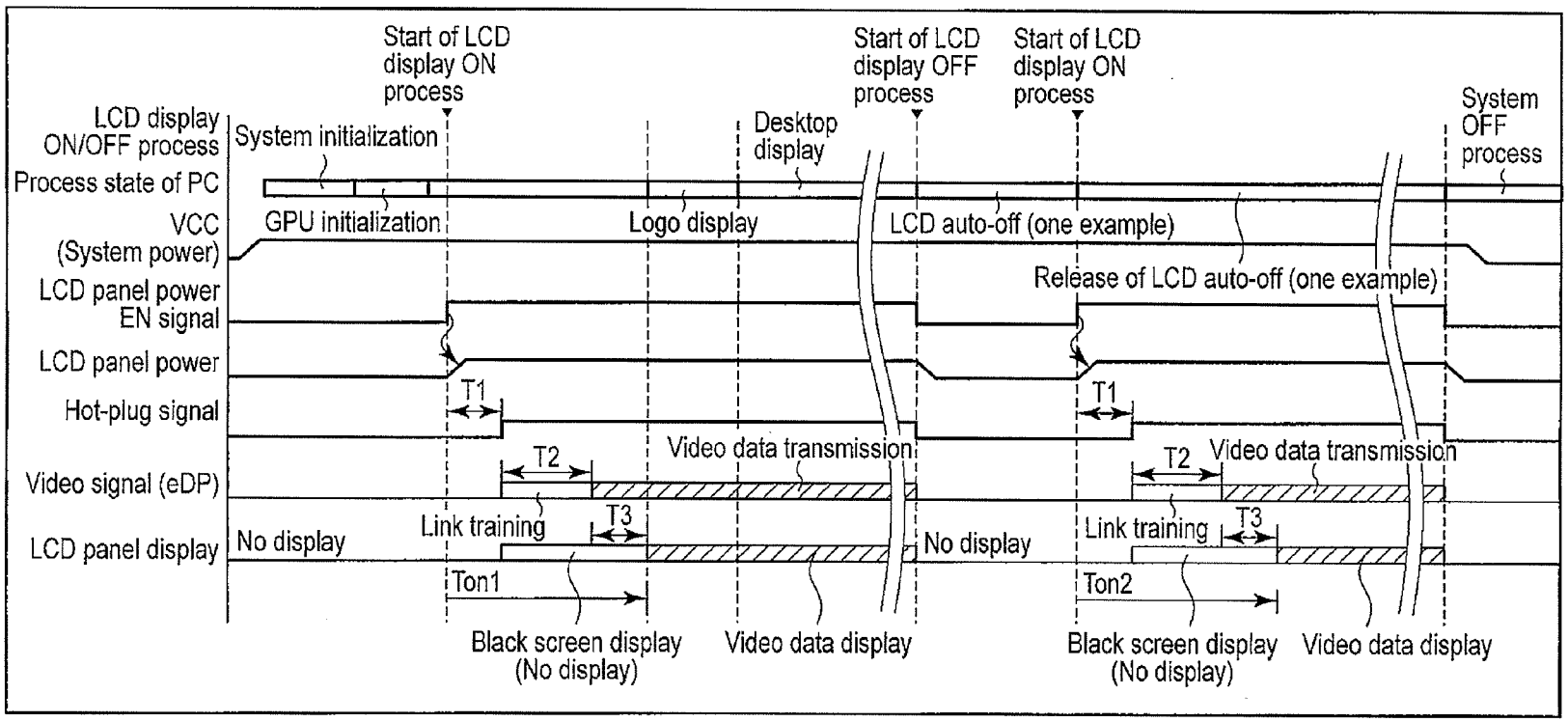
FIG. 4 is a timing chart illustrating an example of a display panel control sequence.
Figure 5:
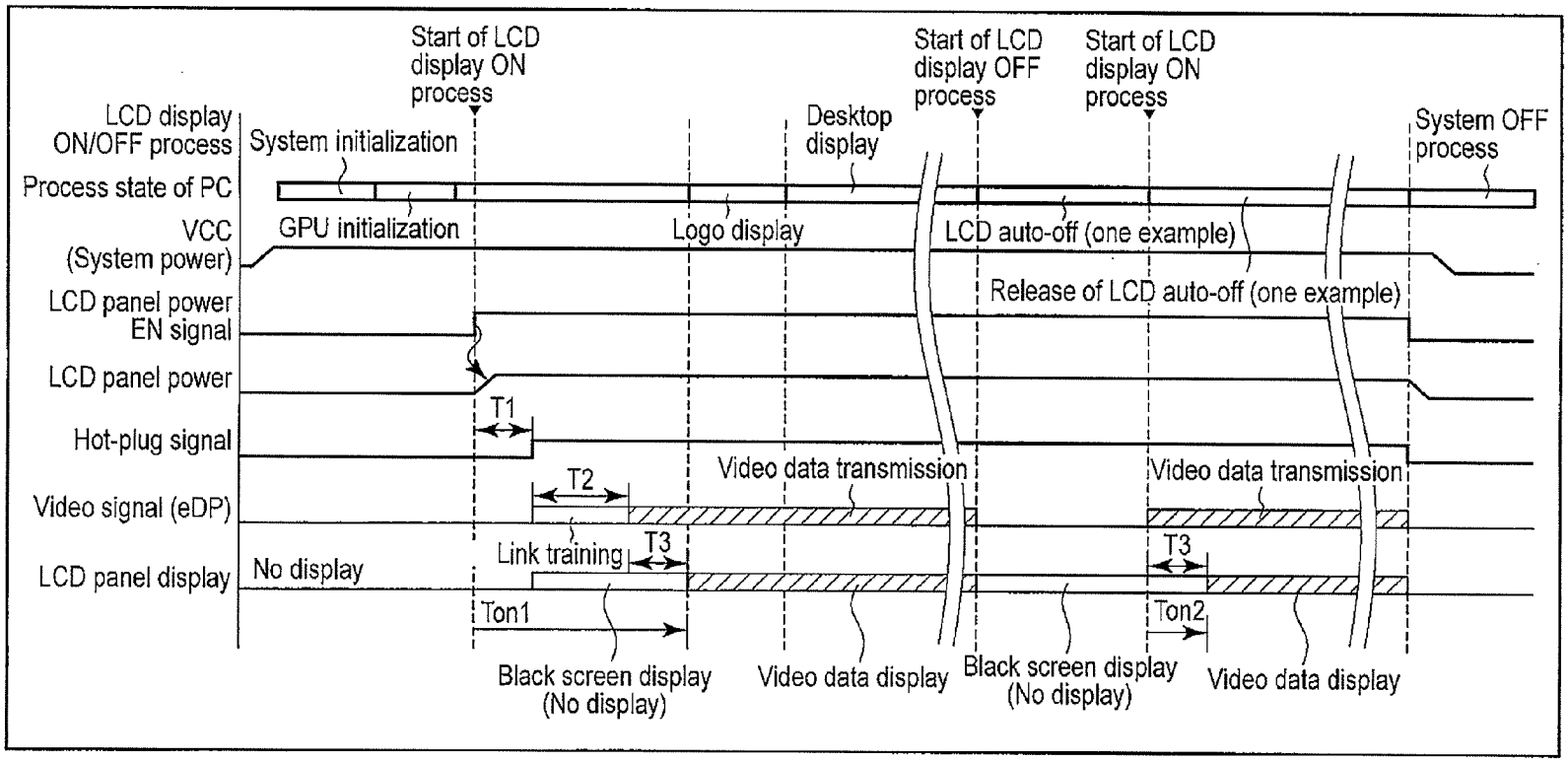
FIG. 5 is a timing chart illustrating an example of a display panel control sequence which is executed by the electronic apparatus of the embodiment.

Next, referring to FIG. 4 and FIG. 5, a description is given of the power-supply sequence (display ON sequence) which is executed by the controller 114A.

FIG. 4 illustrates timing control in a case where the hot-plug signal process and the link training process are executed in each power-supply sequence, that is, each time the display ON request event occurs. FIG. 5 illustrates timing control in a case where the hot-plug signal process and link training process are executed only in the first power-supply sequence, and the hot-plug signal process and link training process are skipped in the second and subsequent power-supply sequences. In the present embodiment, the timing control of FIG. 5 is executed.

To begin with, the timing control of FIG. 4 is described.

The system power (VCC) is turned on, and thereby the computer 10 is powered on. In this case, the respective components, such as the graphics controller (GPU) 114 and bridge device 112, are also powered on. The LCD 16 is powered off. Then, a system initializing process, and an initializing process of the GPU 114 are executed. For example, when a display ON request has been received from the BIOS, or when the initializing process of the GPU 114 has been completed, the graphics controller (GPU) 114 starts the power-supply sequence (LCD display ON process).

In the power-supply sequence (LCD display ON process), the LCD panel power enable (EN) signal is set in the active state, and thereby the LCD panel power is turned on, that is, the LCD 16 is powered on. When a time (T1) has passed since the power-on of the LCD 16, the hot-plug detection signal (also referred to as "hot-plug signal") is set in the active state by the LCD 16. After executing the process for receiving the hot-plug detection signal, the GPU 114 executes the link training process. After completing the link training process, the GPU 114 transmits the video signal to the LCD 16. As a result, an image (e.g. a logo, a desktop screen, etc.) is displayed on the screen of the LCD 16.

If a display OFF request event has occurred while the system is in the active state, the LCD panel power is turned off, and the transmission of the video signal to the LCD 16 is stopped. Then, if a display ON request event has occurred in the OFF state of the LCD 16, the same power-supply sequence as the above-described power-supply sequence (LCD display ON process) is executed once again.

In the timing control of FIG. 4, T1, T2, T3, Ton1 and Ton2 are as follows:

T1=0 ms(min), 200 ms(max)

T2=10 to 20 ms(typ)

T3=0 ms(min), 50 ms(max)

$$\text{Ton1}=\text{Ton2}=T1+T2+T3=10\ \text{ms(min)},\ 270\ \text{ms(max)}$$

where "min" is a minimum value, "max" is a maximum value, and "typ" is a typical value. Ton1 is a time from LCD panel power-on (start of LCD display ON process) to display of video data on the LCD panel (i.e. the time of the first LCD panel power-supply sequence after system boot-up). Ton2 is a time from LCD panel power-on (start of LCD display ON process) to display of video data on the LCD panel (i.e. the time of each of the second and subsequent LCD panel power-supply sequences after system boot-up). Ton1=Ton2, the minimum value of Ton1 (=Ton2) is 10 ms(min), and the maximum value of Ton1 (=Ton2) is 270 ms(max).

Next, referring to FIG. 5, the timing control of the present embodiment is described.

The first LCD panel power-supply sequence after system boot-up is the same as the power-supply sequence of FIG. 4. After the first LCD panel power-supply sequence is completed, the LCD panel power is kept in the ON state at all times even if an LCD display OFF request event occurs. Accordingly, in the second and subsequent LCD panel power-supply sequences after system boot-up, since LCD panel power-on does not occur, the execution of the hot-plug signal process and link training process can be skipped. As a result, the time needed from the LCD panel power-on (start of LCD display ON process) to display of video data on the LCD panel (i.e. the time of each of the second and subsequent LCD panel power-supply sequences after system boot-up) can be decreased.

Next, the details of the timing control of the present embodiment are described.

The system power (VCC) is turned on, and thereby the computer 10 is powered on (system power-on). In this case, the respective components, such as the graphics controller (GPU) 114 and bridge device 112, are also powered on. The LCD 16 is powered off. Then, a system initializing process and an initializing process of the GPU 114 are executed. For example, when a display ON request (LCD panel display ON request) has been received from the BIOS, or when the initializing process of the GPU 114 has been completed, the graphics controller (GPU) 114 starts the power-supply sequence (LCD display ON process).

In the power-supply sequence (LCD display ON process), the controller 114A of the graphics controller (GPU) 114 requests the bridge device 112 to power on the LCD panel. Thereby, the LCD panel power enable (EN) signal is set in the active state by the bridge device 112, and the LCD panel power is turned on, that is, the LCD 16 is powered on. When a time (T1) has passed since the power-on of the LCD 16, the hot-plug detection signal (also referred to as "hot-plug signal") is set in the active state by the LCD 16. After executing the process (hot-plug signal process) for receiving the hot-plug detection signal, the controller 114A of the GPU 114 executes communication with the LCD 16 via the sub-channel 202, thereby executing the link training process. In the link training process, a negotiation is conducted between the controller 114A of the CPU 114 and the LCD 16. Thereby, as described above, the video signal transmission mode (e.g. the number of lanes of a main data channel to be used, the data transfer rate per lane, and the amplitude of the video signal) of the video signal, which is to be transmitted via the main data channel 201, is determined.

After the link training process has been completed, the controller 114A of the GPU 114 transmits the video signal to the LCD 16 via the main data channel 201 in the video signal transmission mode which has been determined in the link training process. As a result, an image (e.g. a logo, a desktop screen, etc.) is displayed on the screen of the LCD 16.

If a display OFF request event has occurred while the system is in the active state, that is, if a display OFF request has been received from the BIOS, the controller 114A stops the transmission of the video signal to the LCD 16 while keeping the LCD panel power in the ON state. The LCD 16 is configured to display a black screen while the transmission of the video signal to the LCD 16 is stopped. In the meantime, while the transmission of the video signal to the LCD 16 is stopped, the controller 114A may turn off the backlight of the LCD 16.

Then, if a display ON request event has occurred in the OFF state (display OFF state) of the LCD 16, that is, if a display ON request has been received from the BIOS, the controller 114A transmits the video signal to the LCD 16 in the video signal transmission mode which has been determined in the link training process of the first power-supply sequence.

If an event of turning off the system power has occurred, that is, if a system power-off request has been received from the BIOS, the controller 114A requests the bridge device 112 to power off the LCD panel. Thereby, the LCD panel power enable (EN) signal is set in the inactive state by the bridge device 112, and the LCD panel power is turned off, that is, the LCD 16 is powered off.

In the timing control of FIG. 5, T1, T2, T3, Ton1 and Ton2 are as follows:

T1=0 ms(min), 200 ms(max)

T2=10 to 20 ms(typ)

T3=0 ms(min), 50 ms(max)

$$\text{Ton1}=T1+T2+T3=10\ \text{ms(min)},\ 270\ \text{ms(max)}$$

$$\text{Ton2}=T3=0\ \text{ms(min)},\ 50\ \text{ms(max)}.$$

As has been described above, the time from LCD panel power-on (start of LCD display ON process) to display of video data on the LCD panel (i.e. the time of each of the second and subsequent LCD panel power-supply sequences after the system boot-up), namely Ton2, is 0 ms(min) at minimum, and 50 ms(max) at maximum. Therefore, at the time of the second and subsequent power-supply sequences after the system boot-up, the time needed for the transition from the state in which no video (no image) is displayed on the LCD 16 to the state in which video (image) is displayed on the LCD 16 can be decreased.

Figure 6:
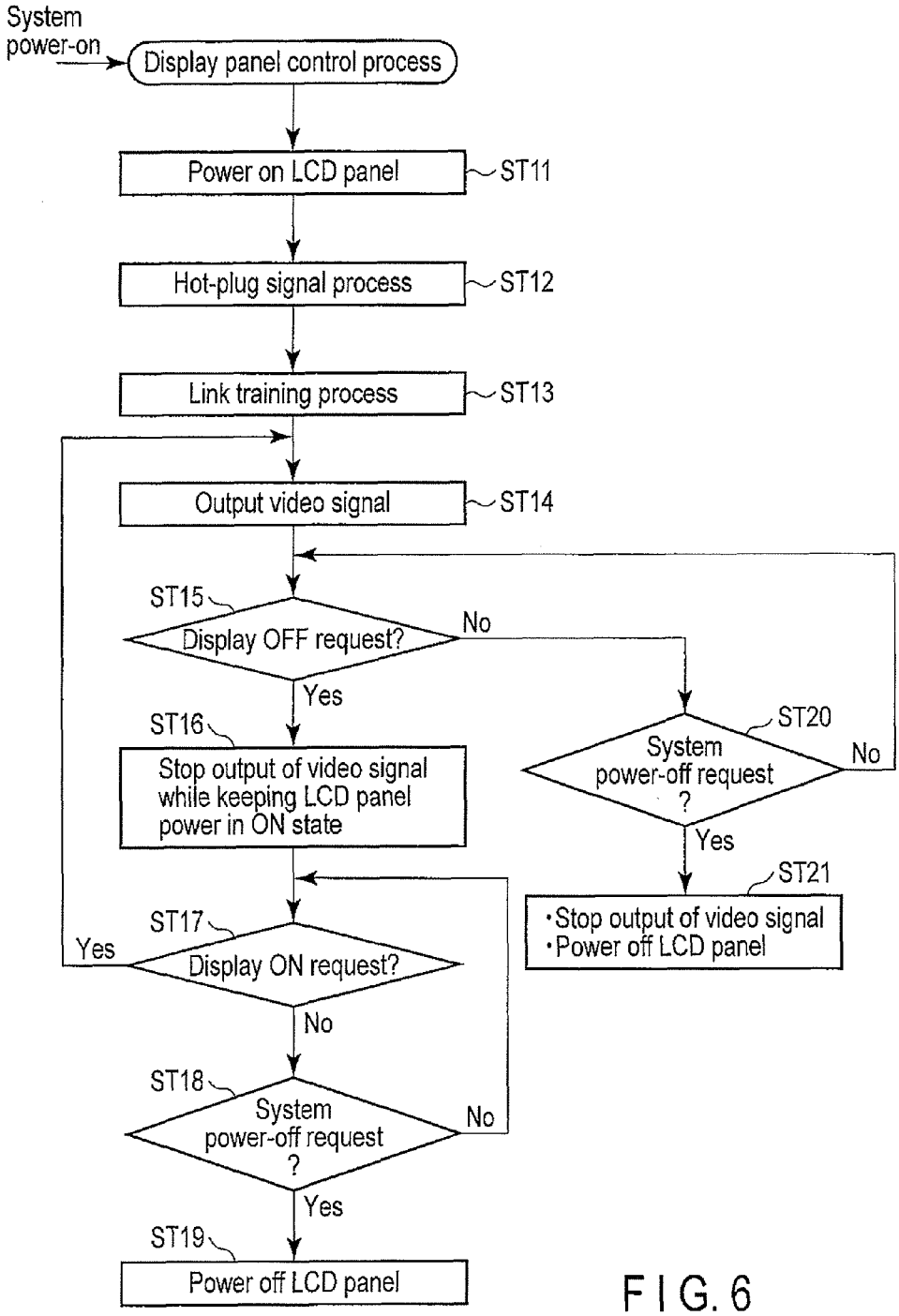
FIG. 6 is a flow chart illustrating an example of the procedure a display panel control process which is executed by the electronic apparatus of the embodiment.

Next, referring to a flow chart of FIG. 6, a description is given of the procedure of a display panel control process of the present embodiment.

After the computer 10 is powered on, the controller 114A powers on the LCD 16 by using the bridge device 112 (step ST11). To be more specific, for example, when a first display ON request (LCD panel display ON request) after system power-on has been received from the BIOS, the controller 114A powers on the LCD 16 by using the bridge device 112.

Then, the controller 114A receives a hot-plug detection signal from the LCD 16 (step ST12). In step ST12, the controller 114A stands by until an active-state hot-plug detection signal, which indicates that the LCD 16 has been set in the active state, is output from the LCD 16. If the controller 114A has received the active-state hot-plug detection signal from the LCD 16, the controller 114A recognizes that the LCD 16 has been set in the active state, and goes to step ST13. In step ST13, the controller 114A executes the above-described link training process for determining the video signal transmission mode.

After completing the link training process, the controller 114A transmits the video signal to the LCD 16 in the video signal transmission mode which has been determined by the link training process (step ST14). Thereby, video is displayed on the LCD 16.

If a display OFF request or a system power-off request is received from the BIOS after the transmission of the video signal to the LCD 16, the controller 114A executes the following process.

Specifically, if the controller 114A receives a display OFF request from the BIOS (YES in step ST15), the controller 114A stops the transmission of the video signal to the LCD 16 in the state in which the LCD 16 is kept in the power-on state (step ST16). In this case, the LCD 16 displays a black screen. On the other hand, if the controller 114A receives a system power-off request from the BIOS (YES in step ST20), the controller 114A stops the transmission of the video signal to the LCD 16 and powers off the LCD 16 by using the bridge device 112 (step ST21).

If the controller 114A receives a display ON request from the BIOS in the state in which the LCD 16 is kept in the power-on state and the transmission of the video signal to the LCD 16 is stopped (YES in step ST17), the controller 114A transmits the video signal to the LCD 16 in the video signal transmission mode which has already been determined in step ST13 (step ST14).

On the other hand, if the controller 114A receives a system power-off request from the BIOS in the state in which the LCD 16 is kept in the power-on state and the transmission of the video signal to the LCD 16 is stopped (YES in step ST18), the controller 114A powers off the LCD 16 by using the bridge device 112 (step ST19).

As has been described above, in the present embodiment, after the computer 10 is powered on, the process of powering on the LCD 16, the process of receiving the hot-plug detection signal from the LCD 16, the link training process for determining the video signal transmission mode, and the process of transmitting the video signal to the LCD 16 in the video signal transmission mode determined by the link training process, are executed. If the display OFF request event has occurred after the transmission of the video signal to the LCD 16, the transmission of the video signal to the LCD 16 is stopped in the state in which the LCD 16 is kept in the power-on state. Further, if the display ON request event has occurred in the state in which the LCD 16 is in the power-on state and the transmission of the video signal to the LCD 16 is stopped, the video signal is transmitted to the LCD 16 in the already determined video signal transmission mode. Thus, it is not necessary to execute, each time the display ON request event occurs, the process of powering on the LCD 16, the process of receiving the hot-plug detection signal from the LCD 16, and the link training process. Therefore, the time (average time) needed for the transition from the state in which no video is displayed on the LCD 16 to the state in which video is displayed on the LCD 16 can be decreased.

In the meantime, the display panel control process of the present embodiment is applicable to not only the computer, but also to various electronic apparatuses. In addition, in the present embodiment, although the case in which the display panel controller 100 is realized by using the graphics controller (GPU) 114 has been described by way of example, a dedicated display panel controller 100, which is independent from the graphics controller (GPU) 114, may be provided.

The various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic apparatus including a display panel, comprising:

a power supply control module configured to power on or power off the display panel; and a control module configured to execute, after the electronic apparatus is powered on, a process of powering on the display panel by using the power supply control module, a process of receiving a hot-plug detection signal from the display panel, a link training process for determining a video signal transmission mode, and a process of transmitting a video signal to the display panel in the video signal transmission mode determined by the link training process, wherein the control module is configured to stop the transmission of the video signal to the display panel in a state in which the display panel is kept in a power-on state, when a display OFF request event occurs after the transmission of the video signal to the display panel, and to transmit the video signal to the display panel in the determined video signal transmission mode, when a display ON request event occurs in a state in which the display panel is in the power-on state and the transmission of the video signal to the display panel is stopped.

2. The electronic apparatus of claim 1, wherein the control module is configured to stop the transmission of the video signal to the display panel and to power off the display panel by using the power supply control module, when an event of requesting power-off of the electronic apparatus occurs in a state in which the display panel is in the power-on state and the video signal is being transmitted to the display panel.

3. The electronic apparatus of claim 1, wherein the display panel is configured to display a black screen while the transmission of the video signal to the display panel is stopped.

4. The electronic apparatus of claim 1, wherein the display panel is configured to support an Embedded Display Port Standard.

5. A display panel control device which controls a display panel provided in an electronic apparatus, comprising:

a power supply control module configured to power on or power off the display panel; and a control module configured to execute, after the electronic apparatus is powered on, a process of powering on the display panel by using the power supply control module, a process of receiving a hot-plug detection signal from the display panel, a link training process for determining a video signal transmission mode, and a process of transmitting a video signal to the display panel in the video signal transmission mode determined by the link training process, wherein the control module is configured to stop the transmission of the video signal to the display panel in a state in which the display panel is kept in a power-on state, when a display OFF request event occurs after the transmission of the video signal to the display panel, and to transmit the video signal to the display panel in the determined video signal transmission mode, when a display ON request event occurs in a state in which the display panel is in the power-on state and the transmission of the video signal to the display panel is stopped.

6. The display panel control device of claim 5, wherein the control module is configured to stop the transmission of the video signal to the display panel and to power off the display panel by using the power supply control module, when an event of requesting power-off of the electronic apparatus occurs in a state in which the display panel is in the power-on state and the video signal is being transmitted to the display panel.

7. A display panel control method of controlling a display panel provided in an electronic apparatus, comprising:

executing, after the electronic apparatus is powered on, a process of powering on the display panel by using the power supply control module, a process of receiving a hot-plug detection signal from the display panel, a link training process for determining a video signal transmission mode, and a process of transmitting a video signal to the display panel in the video signal transmission mode determined by the link training process;

stopping the transmission of the video signal to the display panel in a state in which the display panel is kept in a power-on state, when a display OFF request event occurs after the transmission of the video signal to the display panel; and transmitting the video signal to the display panel in the determined video signal transmission mode, when a display ON request event occurs in a state in which the display panel is in the power-on state and the transmission of the video signal to the display panel is stopped.

8. The display panel control method of claim 7, wherein the transmission of the video signal to the display panel is stopped when an event of requesting power-off of the electronic apparatus occurs in a state in which the display panel is in the power-on state and the video signal is being transmitted to the display panel.

* * * * *